United States Patent [19]

Buettner

[11] Patent Number: 4,831,655

[45] Date of Patent: May 16, 1989

[54] HINGE FOR A HEARING AID COVER

[75] Inventor: Gerhard Buettner, Grossenseebach, Fed. Rep. of Germany

[73] Assignee: Siemens Aktiengesellschaft, Berlin, Fed. Rep. of Germany

[21] Appl. No.: 79,185

[22] Filed: Jul. 29, 1987

[30] Foreign Application Priority Data

Aug. 5, 1986 [DE] Fed. Rep. of Germany ..... 3626519

[51] Int. Cl.[4] ..... H04R 25/00; E05D 3/00; E05D 5/12

[52] U.S. Cl. ..... 381/69; 16/229; 16/380; 16/386

[58] Field of Search ..... 381/69, 69.1, 69.2, 381/68.7, 68; 16/229, 380, 386

[56] References Cited

U.S. PATENT DOCUMENTS 4,390,002 6/1983 Daily, III ..... 16/373
4,570,290 2/1986 Anderson ..... 16/380

OTHER PUBLICATIONS

WO 79/00505, "Hinge", by Hakan Lundberg, published Aug. 1979.
Widex Hearing Aid Co. Product, *Hearing Instruments,* vol. 35, No. 7, Jul. 1984, p. 48.

*Primary Examiner*—Jin F. Ng
*Assistant Examiner*—Danita R. Byrd
*Attorney, Agent, or Firm*—Mark H. Jay

[57] ABSTRACT

The housing of a behind-the-ear hearing aid comprises a hinged cover. The hinge is preferably formed by a U-shaped wire spring, that is fastened to the cover and which is resilient at least at its ends. The cover is attached to the housing by inserting the tips of the spring into cavities disposed in the hearing aid housing.

5 Claims, 1 Drawing Sheet

HINGE FOR A HEARING AID COVER

BACKGROUND OF THE INVENTION

1. Field of the Invention

The present invention relates to a hinge for swiveling a cover disposed on the housing of a hearing aid. It also relates to a hearing aid comprising such a hinge.

2. Description of the Prior Art

It is known to provide a hinge for a cover disposed on the housing of a hearing aid by fashioning two pegs which jut from the housing shell using injection molding methods. The cover comprises two corresponding holes or, alternatively, a lateral groove into which the pegs are to be snapped.

If the cover is handled improperly, i.e. by opening or closing the cover too forcefully, it can very easily become unhinged. Furthermore, this could cause the pegs to break off, which would necessitate replacing the entire housing.

SUMMARY OF THE INVENTION

It is an object of the present invention to provide a technically simple hinge, which can withstand a certain degree of improper handling and with which the possibility of damaging the hinge, the cover, or the housing is extremely remote. According to this invention a hinge is provided for swiveling a cover disposed on an opening of the housing of a hearing aid, comprising:

(a) a spring that is resilient at least at its ends;

(b) means for fastening said spring to the cover; and (c) cavities in the housing, wherein said spring detachably engages said cavities in the housing with said ends, so that they can rotate in said cavities.

Also according to this invention a hearing aid is provided, which comprises:

(a) a housing having an opening;

(b) a cover for said opening; and (c) a hinge for said cover, including (c1) a spring that is resilient at least at its ends;

(c2) means for fastening said spring to the cover; and (c3) cavities in the housing, wherein said spring detachably engages said cavities in the housing with said ends, so that they can rotate in said cavities.

The spring is sturdier than the molded pegs commonly employed to date and thus guarantees that the cover is more securely hinged to the hearing aid housing.

The foregoing and other objects, features and advantages of the invention will be apparent from the following more particular description of a preferred embodiment of the invention, as illustrated in the accompanying drawings.

DETAILED DESCRIPTION OF THE PREFERRED EMBODIMENTS

Figure 1:
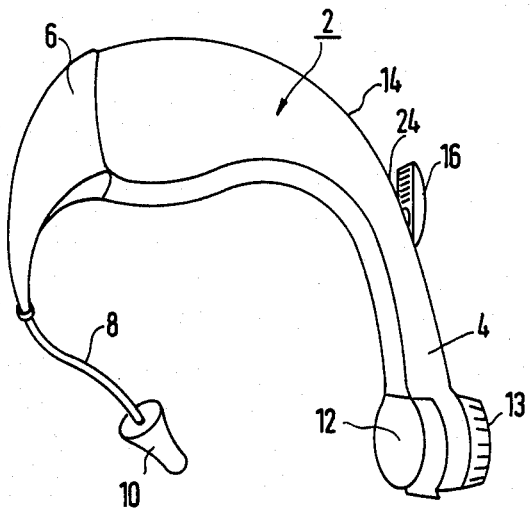
FIG. 1 is a perspective view of a hearing aid with a housing to be worn behind the ear constructed with a hinged cover according to the principles of the present invention.

A behind-the-ear hearing aid is shown in FIG. 1 and is generally referenced at 2. The hearing aid comprises a housing 4 and a hook 6 for positioning the hearing aid behind the user's ear. The hook 6 as well as a tube 8 acoustically connect the hearing aid with an earpiece 10, to be placed in the auditory canal of the ear. The housing 4 itself further comprises a hinged battery compartment 12, a regulator wheel 13 for the volume and a cover 16, shown in a slightly opened position, located on the rear side 14 of the hearing aid 2. A series of regulators (not shown) are arranged within the housing 4 behind cover 16. They are used to regulate the transmission frequency, the automatic gain control (AGC) for the amplifier, and the peak cut-off (PC) of the hearing aid 2.

Figure 2:
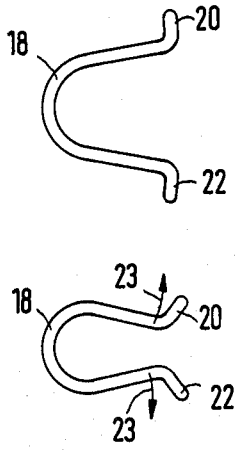
FIG. 2 is an enlarged plan view of a spring employed as a hinge, first in a relaxed position and, second, under tension.

FIG. 2 shows a resilient wire spring 18 as used in the present invention as a hinge for the cover 16 in a relaxed state (FIG. 2, top) and under tension prior to installation (FIG. 2, bottom). In the relaxed state, the spring 18 is substantially U-shaped. The tips 20, 22 of the spring 18 are bent facing outwardly perpendicular to the sides of the U. By pressing the ends of the spring 18 together, it is put under tension. The tips 20 and 22 of the spring 18 can subsequently be threaded through holes provided in the cover 16 and positioned in cavities fashioned in the housing 4, thereby forming the hinge. Once the tips 20 and 22 have been properly positioned in the holes in the cover 16, so that the sides of the spring need no longer be pressed together, the spring exerts a force at its ends directed outwardly, in the direction of arrows 23, thereby allowing the tips 20 and 22 of the spring 18 to snap into the cavities provided in the housing 4.

Figure 3:
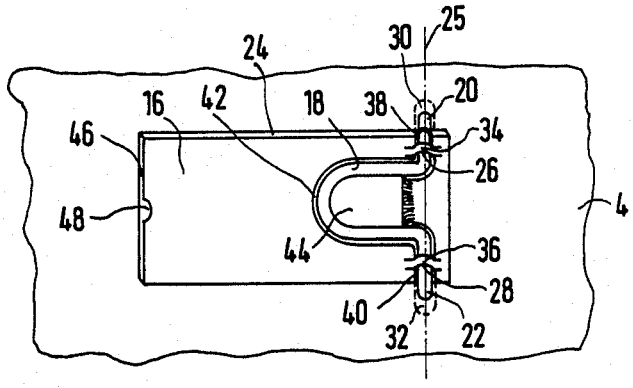
FIG. 3 is an enlarged plan view of a portion of the hearing aid housing showing an engaged spring, as seen from the interior of the hearing aid.

This circumstance is depicted in FIG. 3, where the cover 16 for the opening 24 is hinged to the housing 4 of the hearing aid 2 by means of spring 18. The tips 20, 22 of spring 18 form and hinge around which the cover 16 turns. The holes for the tips 20, 22 in the cover 16 are referenced at 26 and 28, the cavities in housing 4 at 30 and 32. The cavities 30 and 32 recede into housing 4, originating at the edges of opening 24, and are directed along axis 25. The holes 26 and 28 in the cover 16 are fashioned as eyelets passing through two protrusions 34, 36 disposed on the underside of the cover 16. In the prefered embodiment, the eyelets 26 and 28 are not centered in the protrusions 34, 36, but rather partially reach into the actual surface of the cover 16 in the form of excavations 38 and 40. The excavations 38 and 40 are connected by a recess 42 in cover 16, which is adapted to the shape of the spring 18.

The spring 18 is most easily mounted by first threading one tip of the spring 18, for example tip 22, through the corresponding eyelet 28 and into the cavity 32. Then, using tweezers or a small screw driver, the spring 18 can be pressed together, bringing the opposite tip 20 towards tip 22, until it can be threaded into eyelet 26. By releasing the spring 18, the tip 20 snaps into place in the cavity 30. The cover 16 is now hinged to the housing 4.

In order to prevent the spring 18 from inadvertently being released, thereby possibly causing the cover 16 to detach, a stud 44, situated on the underside of the cover 16, is positioned between the sides of the spring, as shown in FIG. 3. With the stud 44 in place, the spring 18 cannot be pressed together or be disengaged from the cavities 30, 32 in housing 4.

The recess 42 provides additional security against an unintentional release of spring 18. Since the spring 18 lies flatly against the cover 16, the possibility of inadvertent damage is greatly reduced. Also, the prefered embodiment takes up none of the limited space within the hearing aid housing.

The cover 16 can now be opened and closed by swiveling it around the axis 25 formed by the hinge. Once closed, the cover 16 is held firmly in place by a securing ridge 46 jutting slightly from the edge of the housing 4 into the opening 24, on the side opposite the hinge. In order to reopen the cover 16, a hole 48 is disposed in the cover adjacent to the securing ridge. The hole 48 will accept, for example, the tip of a small screw driver, with which the cover can be snapped out of its closed position.

If desired, the cover 16 can be removed from the housing 4 by first dislodging the sides of the spring from the stud 44 and then pinching together the spring tips 20, 22 until they have been freed from the cavities 30 and 32.

It should be noted that the hinge described above is not limited to fastening a regulator cover onto the housing of a behind-the ear hearing aid. The hinge is equally suited for securing, for example, a battery cover on an in-the-ear hearing aid. Although still further modifications and changes may be suggested by those skilled in the art, it is the intention of the inventor to embody within the patent warrented hereon all such changes and modifications as reasonably and properly come within the scope of his contribution to the art.

I claim as my invention:

1. A hearing aid, comprising:

(a) a housing having an opening and two cavities;

(b) a cover for said opening, said cover having an inner face and two eyelets which are each at least partially formed by an excavation in said cover;

(c) a hinge for said cover, including (c1) a two-ended spring, which is resilient at least at said ends, said ends engaging the cover and removably engaging said cavities in such a manner that each resilient end passes through a corresponding one of said eyelets on said inner face before engaging said cavity in the housing, and each resilient end is rotatable in said cavity, and (c2) means for fastening said spring to said cover and disposing said spring in a corresponding recess in said inner face; and (d) a stud secured between said ends in such a manner as to prevent said ends from being moved towards each other and thereby being disengaged from said cavities when said stud is so secured.

2. The hearing aid according to claim 1, wherein said spring is fashioned from resilient wire.

3. The hearing aid according to claim 1, wherein each of said eyelets is a protruding loop disposed on said inner face of said cover.

4. The hearing aid according to claim 1, wherein said spring is substantially U-shaped and the ends of said spring are bent outwardly from sides of said U, whereby said sides and ends are resilient perpendicular to said sides of the spring, thereby allowing said ends to be positioned into said cavities.

5. The hearing aid according to claim 1, wherein said stud is mounted to an inner face of said cover.

* * * * *